US009416618B2

(12) United States Patent
Larsen et al.

(10) Patent No.: US 9,416,618 B2
(45) Date of Patent: Aug. 16, 2016

(54) APPARATUS AND METHOD FOR POSITIONING OF A FLUIDIZED PLUGGING MATERIAL IN AN OIL WELL OR GAS WELL

(75) Inventors: Arne Gunnar Larsen, Sandnes (NO); Roy Inge Jensen, Stavanger (NO); Patrick Andersen, Hafrsfjord (NO); Morten Myhre, Tananger (NO)

(73) Assignee: Hydra Systems AS, Tananger (NO)

( * ) Notice: Subject to any disclaimer, the term of this patent is extended or adjusted under 35 U.S.C. 154(b) by 387 days.

(21) Appl. No.: 14/003,424

(22) PCT Filed: Mar. 20, 2012

(86) PCT No.: PCT/NO2012/050047

§ 371 (c)(1), (2), (4) Date: Oct. 16, 2013

(87) PCT Pub. No.: WO2012/128644

PCT Pub. Date: Sep. 27, 2012

(65) Prior Publication Data

US 2015/0308219 A1 Oct. 29, 2015

(30) Foreign Application Priority Data

Mar. 24, 2011 (NO) ..... 20110450
Jan. 31, 2012 (NO) ..... 20120099

(51) Int. Cl.

*E21B 33/13* (2006.01)
*E21B 33/14* (2006.01)
*E21B 17/22* (2006.01)
(Continued)

(52) U.S. Cl.

CPC ..... *E21B 33/13* (2013.01); *E21B 17/22* (2013.01); *E21B 27/02* (2013.01); *E21B 33/134* (2013.01); *E21B 33/14* (2013.01); *E21B 37/02* (2013.01)

(58) Field of Classification Search

CPC ..... E21B 33/13; E21B 33/14; E21B 17/1078; E21B 17/22

See application file for complete search history.

(56) References Cited

U.S. PATENT DOCUMENTS 1,460,632 A * 7/1923 Wigle ..... E21B 3/025 166/241.6
2,402,223 A 6/1946 Wright
(Continued)

FOREIGN PATENT DOCUMENTS

NO 20111641 A1 7/2012

OTHER PUBLICATIONS

International Search Report for parent application PCT/NO2012/050047, having a mailing date Jun. 8, 2012.
(Continued)

*Primary Examiner* — Shane Bomar
(74) *Attorney, Agent, or Firm* — Andrus Intellectual Property Law, LLP

(57) ABSTRACT

An apparatus and a method are for supplying a fluidized plugging material to a well. The apparatus includes: a carrier body defined by an indefinite side portion extending between a first end portion and a second end portion, the carrier body being arranged to be set in motion by a driving device; and at least one displacement member arranged on the carrier body, the displacement member being defined by the surface of the carrier body and a free end portion facing the inside of the casing, and the driving device being arranged to set the carrier body and the displacement member in motion in the bore of the casing, so that the fluidized plugging material is set in motion within the bore of the casing.

25 Claims, 12 Drawing Sheets

(51) Int. Cl.

| | |
|---|---|
| ***E21B 27/02*** | (2006.01) |
| ***E21B 33/134*** | (2006.01) |
| ***E21B 37/02*** | (2006.01) |

(56) References Cited

U.S. PATENT DOCUMENTS

| | | | | | |
|---|---|---|---|---|---|
| 2,607,425 | A * | 8/1952 | Taylor | E21B 33/14 | 166/183 |
| 3,260,310 | A * | 7/1966 | Brown | E21B 33/1294 | 166/131 |
| 3,276,521 | A * | 10/1966 | Turbyfill | E21B 37/02 | 15/104.16 |
| 3,351,136 | A * | 11/1967 | Nelson | E21B 17/1035 | 166/173 |
| 4,088,185 | A | 5/1978 | Carson | | |
| 4,456,064 | A * | 6/1984 | Ford | E21B 37/02 | 166/173 |
| 4,595,058 | A * | 6/1986 | Nations | E21B 17/1078 | 166/242.1 |
| 4,995,456 | A | 2/1991 | Cornette et al. | | |
| 5,657,822 | A | 8/1997 | James et al. | | |
| 6,311,774 | B1 | 11/2001 | Brockman et al. | | |
| 6,828,531 | B2 * | 12/2004 | Spencer | E21B 33/13 | 166/304 |
| 8,443,882 | B2 * | 5/2013 | Barnard | E21B 17/10 | 166/241.4 |
| 8,826,986 | B2 * | 9/2014 | Wolf | E21B 37/02 | 166/173 |
| 9,010,425 | B2 * | 4/2015 | Larsen | E21B 33/13 | 166/285 |
| 2010/0039879 | A1 * | 2/2010 | Buytaert | E21B 33/14 | 366/6 |
| 2010/0155067 | A1 | 6/2010 | Tunget | | |
| 2011/0042081 | A1 * | 2/2011 | Streich | C09K 8/42 | 166/269 |

OTHER PUBLICATIONS

Written Opinion for parent application PCT/NO2012/050047, having a mailing date of Jun. 8, 2012.

* cited by examiner

APPARATUS AND METHOD FOR POSITIONING OF A FLUIDIZED PLUGGING MATERIAL IN AN OIL WELL OR GAS WELL

CROSS-REFERENCE TO RELATED APPLICATIONS

This application is the U.S. national stage application of International Application No. PCT/NO2012/050047, filed Mar. 20, 2012, which International application was published on Sep. 27, 2012 as International Publication No. WO 2012/128644 A2 in the English language and which application is incorporated herein by reference. The International application claims priority of Norwegian Patent Application Nos. 20110450, filed Mar. 24, 2011, and 20120099, filed Jan. 31, 2012, which applications are incorporated herein by reference.

BACKGROUND

The present invention relates to an apparatus for use when plugging a well within the petroleum industry. More particularly, it relates to an apparatus for use when positioning a fluidized plugging material in an oil well or a gas well which is lined with a casing, the apparatus including: a driving body; a carrier body defined by an indefinite side portion extending between a first end portion and a second, end portion, the carrier body being arranged to be set in motion by the driving body; and at least one displacement member arranged on the carrier body.

When abandoning an oil well or a gas well temporarily or permanently, it is required that the well should be secured with a plugging material which has sufficient strength and tightness to prevent leakage between a petroleum-bearing formation and the surface of the well. To provide such a plug, it is common to fill a portion of the well with a fluidized plugging material. The fluidized plugging material usually comprises a cement slurry for the formation of a hardenable cement plug. But it is to be understood that the fluidized plugging material may comprise a fluidized unconsolidated material for the formation of an unconsolidated-material plug. The description that follows will be directed, to a great extent, towards a cement plug. However, the present invention is also well suited for positioning an unconsolidated-material plug. The extent of the plug in the longitudinal direction of the well is typically 50 meters, but is dependent on international, national or oil/gas contractors' internal requirements.

Till now, it has been common to provide a cement plug by first removing the casing in the area in which the plug is to be established. Such a removal is typically carried out by means of a cutting tool. After the desired portion of the casing has been removed, the wellbore is widened by means of a drilling tool, a so-called "reamer", to provide a best possible attachment between the plug and the surrounding formation. Then cement is carried into the widened wellbore.

Such a method is very time-consuming and expensive, while, at the same time, metal chips from the casing may result in a need for extensive and expensive maintenance of upstream equipment.

The industry therefore has a strong need for quicker methods, and methods in which the casing is left in the well.

The purpose of the present invention is to provide an apparatus and a method for providing a complete and reliable attachment of a fluidized plugging material in an oil well or a gas well. This is achieved by providing sufficient contact between the surface of the bore to be plugged and the plugging material. The apparatus and the method may be used both when plugging a non-perforated portion of a casing, when plugging a perforated casing, in which the plugging material fills most of the annulus between the formation and the centre of the casing, as well as when plugging a so-called openhole section.

In his Norwegian patent application NO201117641, the present applicant has described a perforation and washing apparatus arranged to prepare a perforated casing for grouting and forming a plug in a well. The plug can be temporary or permanent.

To provide reliable engagement between the casing and the plugging material, and to ensure that an annulus between the outside of the casing and the formation will also be sufficiently plugged by means of the plugging material, there is a need to communicate the plugging material from the inside of the casing to the outside of the casing. But there is also a need to be able to drain away a liquid that might be present in the annulus between the outside of the casing and the formation, so that the liquid will not prevent the inflow of plugging material into said annulus.

From the publication US 2010/039879, an apparatus and a method for agitating a cement slurry in an annulus defined between a formation wall and a casing in a well are known. The apparatus includes a sleeve which is provided with an agitating device and which is arranged to rotate relative to the casing. The apparatus is placed on the outside of a portion of the casing.

From the publication U.S. Pat. No. 4,595,058 a cementing tool for ensuring sufficient sealing of an annulus between a riser and a casing is known. The cementing tool is constituted by a pipe piece which has flow-directing rigid ribs welded thereon to provide a turbulent flow between the riser and the casing when the pipe piece is set in rotation.

From the publication U.S. Pat. No. 4,995,456 an apparatus and a method for providing a gravel pack around a production tubing in a well are known. The apparatus includes helical rigid blades welded on or otherwise attached to a completion tool.

SUMMARY

The invention has for its object to remedy ox reduce at least one of the drawbacks of the prior art or at least provide a useful alternative to the prior art.

The object is achieved through features which are specified in the description below and in the claims that follow.

In a first aspect of the present invention an apparatus for use when positioning a fluidized plugging material in an oil well or a gas well lined with a casing is provided, the apparatus including:

- a driving body;
- a carrier body defined by an indefinite side portion extending between a first end portion and a second end portion, the carrier body being arranged to be set in motion by the driving body; and
- at least one displacement member arranged on the carrier body, the displacement member being defined by the surface of the carrier body and a free end portion facing the inside of the casing, and the driving body being arranged to set the carrier body and the displacement member in motion in the bore of the casing, so that the fluidized plugging material is set in motion within the bore of the casing.

As the plugging material is set in motion, the displacement member will provide a pressure change in the fluidized plugging material.

The driving body may be a pipe string which is arranged to be set in rotation around a longitudinal axis of the casing, so that the movement of the apparatus is a rotational movement around the longitudinal axis of the casing, in an alternative embodiment, the driving body may be a motor which is positioned in or in connection with the apparatus and which is supplied with power from the surface of the well.

The displacement member may be a blade. In one embodiment, at least by rotation of the carrier body, the free end portion of the blade is arranged to exhibit a deflection relative to a central contact portion between the blade and the carrier body. This has the effect of the displacement member exhibiting a "spatula effect" wherein the plugging material is pressed or "spread" against the internal surface of the casing. In what follows, the central contact portion between the blade and the carrier body will also be referred to as an attachment portion, independently of whether the blade or a displacement member of some other kind is attached on the outside of or in the carrier body, or whether the displacement member is made in one piece with the carrier body.

The apparatus may be formed in such a way that, by rotation, the carrier body and the at least one blade circumscribe a circle which has a diameter that is larger than the internal diameter of the casing. Thereby, even as the apparatus is being positioned in the casing, the at least one blade will be brought to assume a curvature. In this embodiment, the projecting end portion of the blade may abut against the internal surface of the casing also after the apparatus has been set in rotation. But the blade could also be exposed to such a great force from the plugging material that it bends to such a great extent that it does not abut against the internal surface of the casing.

In one embodiment, the apparatus is formed in such a way that, by rotation, the carrier body and the at least one blade circumscribe a circle which has a diameter which is equal to or smaller than the internal diameter of the casing.

The at least one blade may be arranged, in such a way at the carrier body that the longitudinal axis of the blade extends parallel to a longitudinal axis of the carrier body. In an alternative embodiment, the longitudinal axis of the at least one blade extends at an angle relative to the longitudinal axis of the carrier body.

The driving body may be a reciprocating driving means which is arranged to provide a to-and-fro movement of the at least one displacement member along the longitudinal axis of the casing. When a reciprocating driving means is used, it may be an advantage if the displacement member is a collar-shaped body. The free end portion of the collar-shaped body may, at least when moving, be arranged to exhibit a deflection relative to a central contact portion between the blade and the carrier body. This has the effect of the displacement member exhibiting a "spatula effect" against the internal surface of the casing, as explained above. As mentioned above, the central contact portion between the blade and the carrier body will also be referred to as the attachment portion.

In one embodiment, the collar-shaped body extends in a helix around the carrier body. This has the effect of the fluidized plugging material being brought to move around the longitudinal axis of the casing in addition to moving along the longitudinal axis of the casing.

It may be an advantage if the collar-shaped body extends at least 360° around the carrier body, so that the displacement member will work against the entire circumference of the internal surface of the casing. If the driving body is arranged to impart a reciprocating motion to the carrier body, both along the longitudinal axis of the casing and around the longitudinal axis of the casing, the collar-shaped body may extend less than 360° around the carrier body.

The collar-shaped body may be formed in one piece or then it may be formed of at least two collar sector elements. The at least two collar sector elements may or may not be formed in such a way that they partly overlap.

At least one of the collar sector elements may be provided with a hinged attachment portion, so that the free end portion is allowed to be brought in towards the carrier body when the apparatus is moved in one of the backward or forward movements. This "jellyfish motion" has the effect of the collar sector elements providing full effect only in one of the backward and forward movements. Such a "jellyfish motion" is particularly useful in the cases in which it is desirable to provide an increased differential pressure between two portions of the column of the fluidized plugging material.

The fluidized plugging material may be a hardenable material, such as of the kind that is cement-based, for example. To facilitate pulling of the apparatus from the well in case the hardening process in such a material exceeds a predetermined level, it may be an advantage if the load capacity of the at least one displacement member is higher than the loads affecting the displacement member by movement of the apparatus in non-hardened plugging material, but lower than the loads affecting the displacement member by movement of the apparatus in hardened plugging material, so that at least a portion of the displacement member will break if the hardening process exceeds said predetermined level.

The carrier body may have a cylindrical shape. In an alternative embodiment of the present invention, the apparatus is provided with a carrier body which, in one portion, has a larger external diameter than another portion of the carrier body. Said different diameters are preferably in portions from which the at least one displacement member projects, and may provide different flow rates along the apparatus.

The at least one displacement member may include two or more spaced-apart displacement members. The displacement members may be arranged substantially parallel to each other, or the displacement members may be arranged non-parallel. For example, when blade type displacement members are used, the longitudinal axis or at least one of the blades may be arranged parallel to the longitudinal axis of the carrier body, whereas the longitudinal axis of at least one other of the blades may be arranged at an angle relative to a longitudinal axis of the carrier body.

The apparatus may be constituted by several apparatuses arranged in series or in a so-called stack. Such an apparatus may be assembled from apparatuses having any kind of displacement members as described herein, or a combination thereof.

The apparatus according to the present invention may thus be used both when permanently or temporarily plugging a casing which is provided with perforations, wherein movement of the apparatus drives a portion of a fluidized plugging material out through the perforations and to an outside of the casing, and when permanently or temporarily plugging a non-perforated casing, wherein movement of the apparatus drives the fluidized plugging material into engagement with the internal surface of the casing.

According to a second aspect of the present invention, a method for providing a permanent or temporary plug in a casing in a well is provided, wherein the plug is provided by means of a fluidized plugging material which is carried into the well from a surface, the method including the steps of:

moving the apparatus according to the first aspect of the invention into the well;

setting the apparatus in motion and supplying the fluidized plugging material from the surface of the well;

continuing the movement for a predetermined time after all the plugging material has been supplied; and pulling the apparatus out of the well.

By placing the apparatus on an inside of the casing and, at the same time, providing one or more displacement members exhibiting a deflection relative to the attachment portion of the blade, as explained above, the free end portion of the displacement member, facing the internal surface of the casing, will exhibit a lag relative to the attachment portion of the displacement member. This lag turns out to be very favourable for pressing or "spreading" the plugging material against the inside of the casing.

The casing, into which the apparatus according to the first aspect is run, may be non-perforated or perforated.

Full-scale laboratory testing of the apparatus used in a perforated casing has surprisingly shown that while the plugging material is flowing from the inside of the casing to the outside, a fluid flow occurs simultaneously in the opposite direction, from the outside of the casing to the inside, that is. An adequate explanation of why such opposite flows arise has not been found, but it is conceivable that some flow regimes of plugging material out through some of the perforations arise as the apparatus is set in rotation, and that these flow regimes are maintained, forcing the liquid present in the annulus on the outside of the casing away.

A person skilled in the art will be acquainted with the fact that the internal surface of a non-perforated casing may be contaminated with chemicals such as an oil film, for example, and/or by contamination of a more mechanical kind, such as rust particles, for example. This contamination may occur in one or more sections of the portion of the casing to which a plugging material is to be supplied, or in the entire portion of the casing to which a plugging material is to be supplied. This contamination may result in the engagement or adhesion between the plugging material, which may be cement-based, and the casing not being sufficiently strong.

It is known to remove mechanical contamination by means of a scraping device which is moved into the well, working the surface of the casing before a cementing tool, for example, is moved into the well and supplies a cement-based plugging material. Such a scraping device will be able remove particles that are relatively loose. Rust is an example of such loose particles. However, it turns out that such a scraping device is not sufficient to remove chemical contamination such as an oil film, for example.

Laboratory tests have surprisingly shown that the apparatus is well suited for removing a chemical film of, for example, oil that might be present on the inside of the casing. A possible explanation of why this happens could be that particles present in the fluidized plugging material have an abrasive effect on the internal surface of the casing in consequence of the movement of the plugging material relative to the surface, or mechanical rubbing/wiping (like a windscreen wiper) removing a chemical deposit.

When a casing that is perforated is being permanently or temporarily plugged, the contamination discussed above in connection with the non-perforated casing will not be of equally great importance to the engagement between the casing and the fluidized plugging material. This is owing to the fact that the apparatus according to the present invention will drive the plugging material out through the perforations and into the annulus located between the outside of the casing and the formation. The plugging material will thereby provide a continuous plug from the inside of the casing, via the perforations and into said annulus and, thus, surround the casing completely. When the annulus has been washed by means of the apparatus and the method according to the applicant's patent application NO20111641, the bonding or adhesion between the annulus and the plugging material will be particularly good.

A person skilled in the art will be familiar with the fact that one of the challenges when plugging back a newly drilled open-hole section is to achieve full contact between the plugging material and the hole section (formation).

It has surprisingly turned out that the apparatus and method according to the invention are also well suited for plugging a so-called open-hole section of a well. The flow of the fluidized plugging material provided by means of the apparatus will drive the plugging material against the formation in the open well section and, thus, provide a sufficient distribution of the plugging material in the entire cross section of the wellbore. This is particularly important in high-deviation wells, or horizontal well sections, in which the plugging material normally has a considerably greater density than the fluid present in the well. In such regions, the plugging material will settle at the bottom of the well path (on the low side of the cross section of the well) and may thus form a passage on the high side of the cross section of the well.

In a third aspect of the present invention an apparatus according to the first aspect of the invention is used when an open-hole section of a well is being plugged permanently or temporarily, wherein movement of the apparatus drives a fluidized plugging material into engagement against the formation of the well.

BRIEF DESCRIPTION OF THE DRAWINGS

In what follows, an example of a preferred embodiment is described, which is visualized in the accompanying drawings, in which.

DETAILED DESCRIPTION OF THE DRAWINGS

Figure 1A:
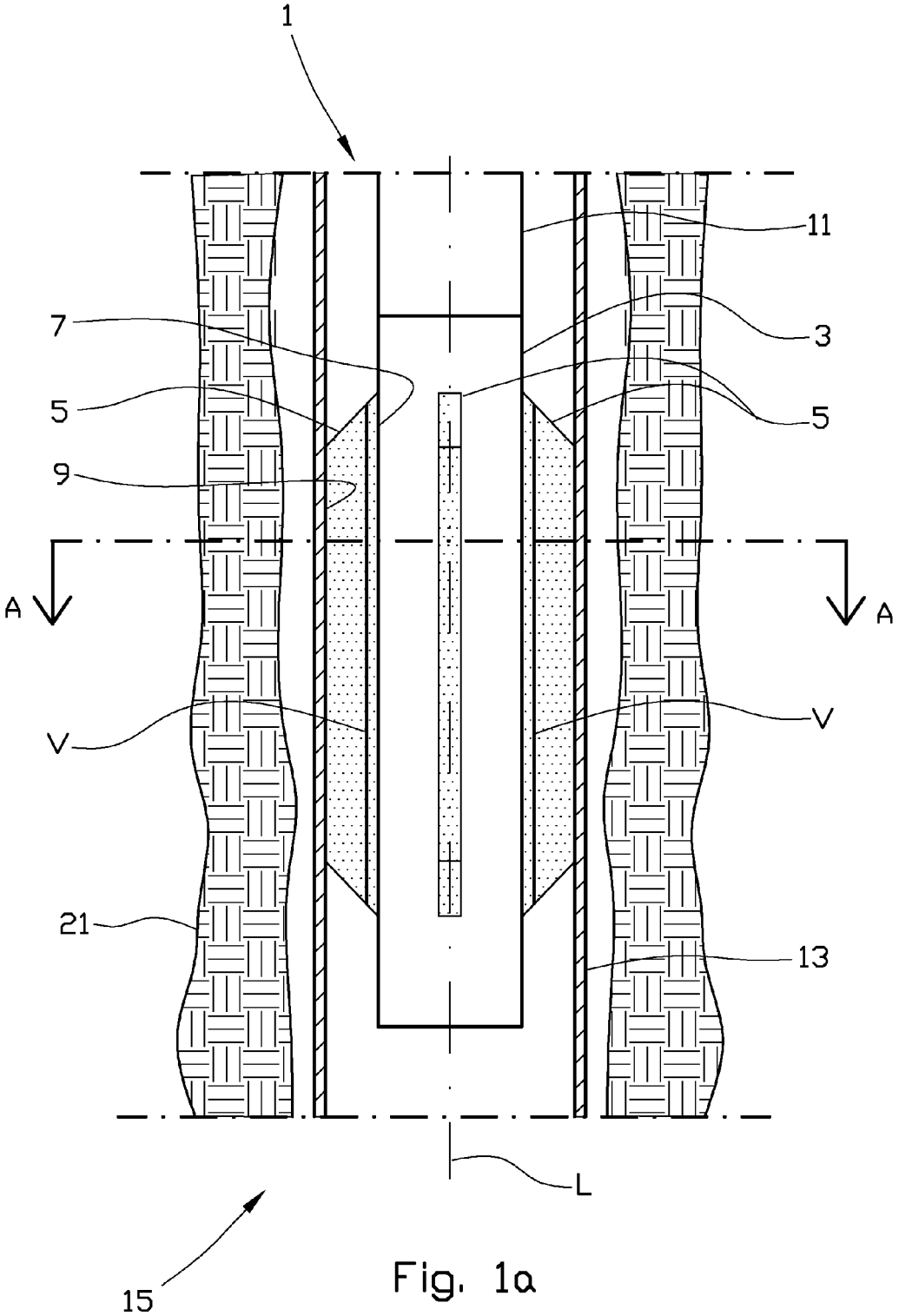
FIG. 1*a* shows a view, seen from a side of an apparatus according to the present invention in an embodiment in which the apparatus is provided with displacement members which are arranged substantially parallel to a longitudinal axis of a casing arranged in a drilled wellbore, the casing and the wellbore being shown in a cross-sectional view.

Like or corresponding elements are indicated by like reference numerals in the figures.

A person skilled in the art will understand that the figures are just principle drawings. The relative proportions between individual elements may also be strongly distorted.

Positional indications such as "above", "below", "upper", "lower", for example, refer to the position shown in the figures.

In the figures, the reference numeral 1 indicates an apparatus according to the present invention. The apparatus 1 includes a carrier body 3 with at least one displacement member 5 arranged thereon. The displacement member 5 is radially defined by a contact portion 7 between the blade and the carrier body and a free end portion 9. The contact portion will be referred to, in what follows, as the attachment portion 7. The carrier body 3 is connected to a driving device 11 which is arranged to set the carrier body 3 and thus the displacement member 5 in motion.

The apparatus 1 is designed to be positioned in a bore of a casing 13 placed in a well 15.

Figure 1B:
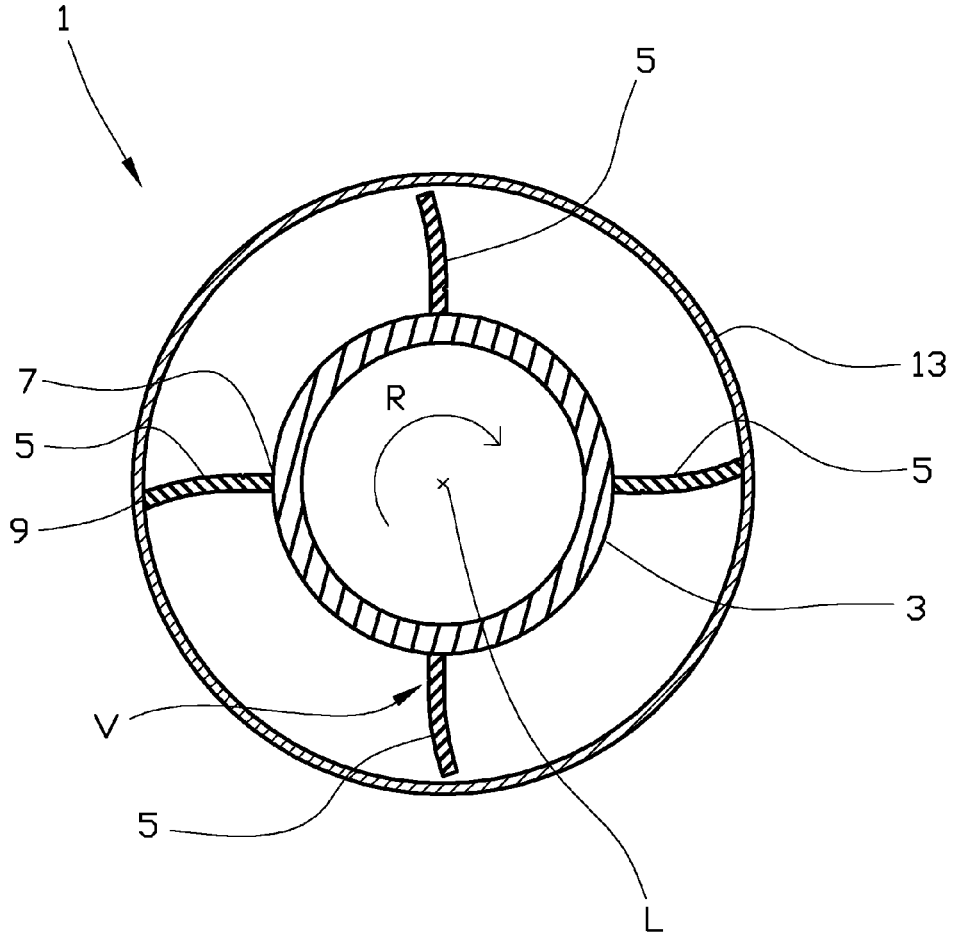
FIG. 1*b* shows, on a larger scale, a cross-sectional view seen through the line A-A of FIG. 1*a* after the apparatus has been set in a rotation, but in which only the apparatus and the casing are shown.

FIGS. 1*a* and 1*b* show, respectively, a side view and a cross-sectional view seen through A-A in FIG. 1*a* of the apparatus 1 according to a first embodiment, of the present invention. The section is shown only of the apparatus and of the casing. In the embodiment shown, the at least one displacement member 5 is constituted by several elongated blades 5 (four shown in FIG. 1*b*) extending parallel to a longitudinal axis L of the casing 13. In FIG. 1*a*, the blades 5 are marked with dotted shading for clarity.

An upper end portion of the apparatus 1 is connected, for example by means of a screw connection, to a pipe string 11 which is arranged to be set in rotation by means of a driving means known per se (not shown). Thus, the pipe string 11 constitutes said driving device 11.

When the pipe string 11 is rotated, the apparatus 1 will also be set in a rotation R around the longitudinal axis L of the casing 13.

To provide a sufficient degree of said spreading or spatula effect of the displacement members or blades 5 against the internal surface of the casing 13, independently of this being non-perforated or perforated, it is desirable that the free end portion 9 of the blades 5 exhibits a certain deflection relative to the attachment portion 7 of the blades 5. Such a deflection is illustrated in FIG. 1*b*.

The deflection may be achieved in several ways.

A first way is to provide an apparatus 1 in which, by rotation, the carrier body 3 and the blades 5 circumscribe a circle that is larger than an internal diameter of the casing 13 into which it is to be moved. This assumes that the blades 5 are formed out of a flexible material which may deflect when being moved into the casing 13.

A second way in which to achieve the desired deflection is to provide an apparatus in which, by rotation in the casing 13, the carrier body 3 and the blades 5 circumscribe a circle which has a diameter equal to or smaller than the internal diameter of the casing 13, but in which the blades 5 are formed out of a flexible material.

Independently of said first and second ways, a. material may be selected from any bendable or flexible material which is suitable for placing a fluidized plugging material such as a cement slurry, for example, in a well 15. One example of such a suitable material is a rubber-based material. Another example is a suitable steel.

In the first way, a blade based on rubber will exhibit a "windscreen-wiper effect" or a "spatula effect" against the internal surface of the casing 13. A blade 5 based on steel may exhibit a "steel-putty-knife effect".

It will be understood that a carrier body 3 may be provided with blades 5 made of the same material or of different materials. By way of example, in FIGS. 1*a* and 1*b*, two of the blades 5 may be made of rubber, whereas the other two blades 5 may be made out of steel sheets.

In FIG. 1*b*, two of the blades 5 (the right and left blades) are such as described above for the first way, whereas the other two of the four blades 5 (upper and lower blades) are as described above for the second way. However, it will be understood that the blades 5 of one carrier body 3 may be formed with identical blades 5.

As mentioned, the fluidized plugging material may be a hardenable material, for example a cement-based material. To reduce the risk of the apparatus 1 not being pullable from the well 15, for example by the hardening process having got too far, the blades 5 may be provided with a weakening, for example in the form of a nicking V as shown in FIGS. 1*a* and 1*b*. The load capacity of one or more of the blades 5 can thereby be set to be higher than the loads affecting the blades 5 by movement of the apparatus 1 in non-hardened plugging material, but lower than the loads affecting the blades 5 when an attempt is made to move the apparatus 1 in hardened plugging material, so that at least a portion of the blade 5 will break if the hardening process exceeds a predetermined level.

Figure 2:
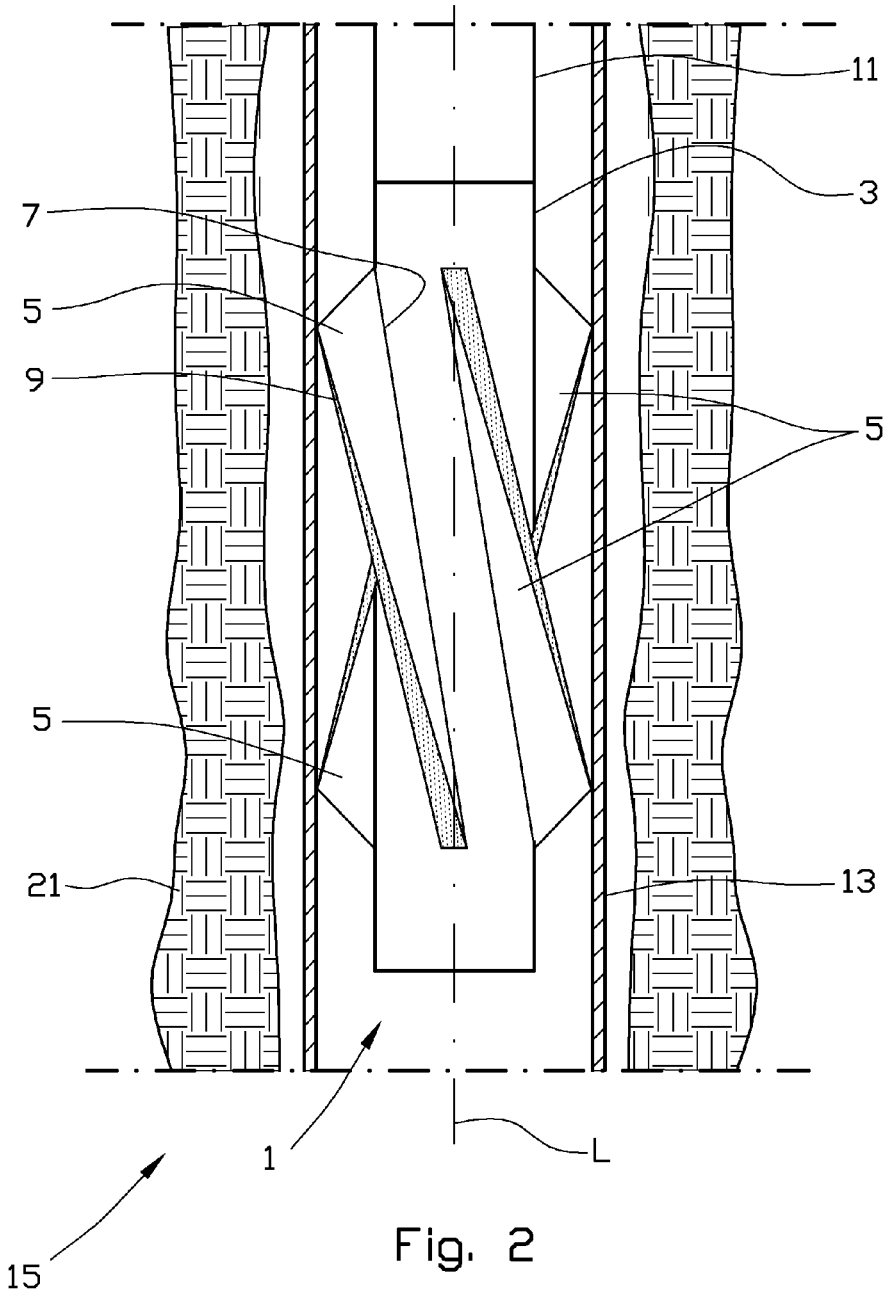
FIG. 2 shows an alternative embodiment of the apparatus of FIG. 1*a*, in which the apparatus is provided with displacement members extending in a partially helical shape around a longitudinal axis of the casing.

FIG. 2 shows an apparatus resembling the apparatus 1 shown in FIG. 1*a*, but with the difference that the displacement members 5 are constituted by elongated blades extending at an angle relative to the longitudinal axis L of the casing 13, in a partially helical shape around the external surface of the carrier body 3, that is. For clarity, the free end portion 9 of the blades 5 are marked with dotted shading.

The blades 5 in FIG. 2 may have the same design with respect to their radial extent from the carrier body 3 as the blades 5 mentioned in connection with FIGS. 1*a* and 1*b*.

Figure 3:
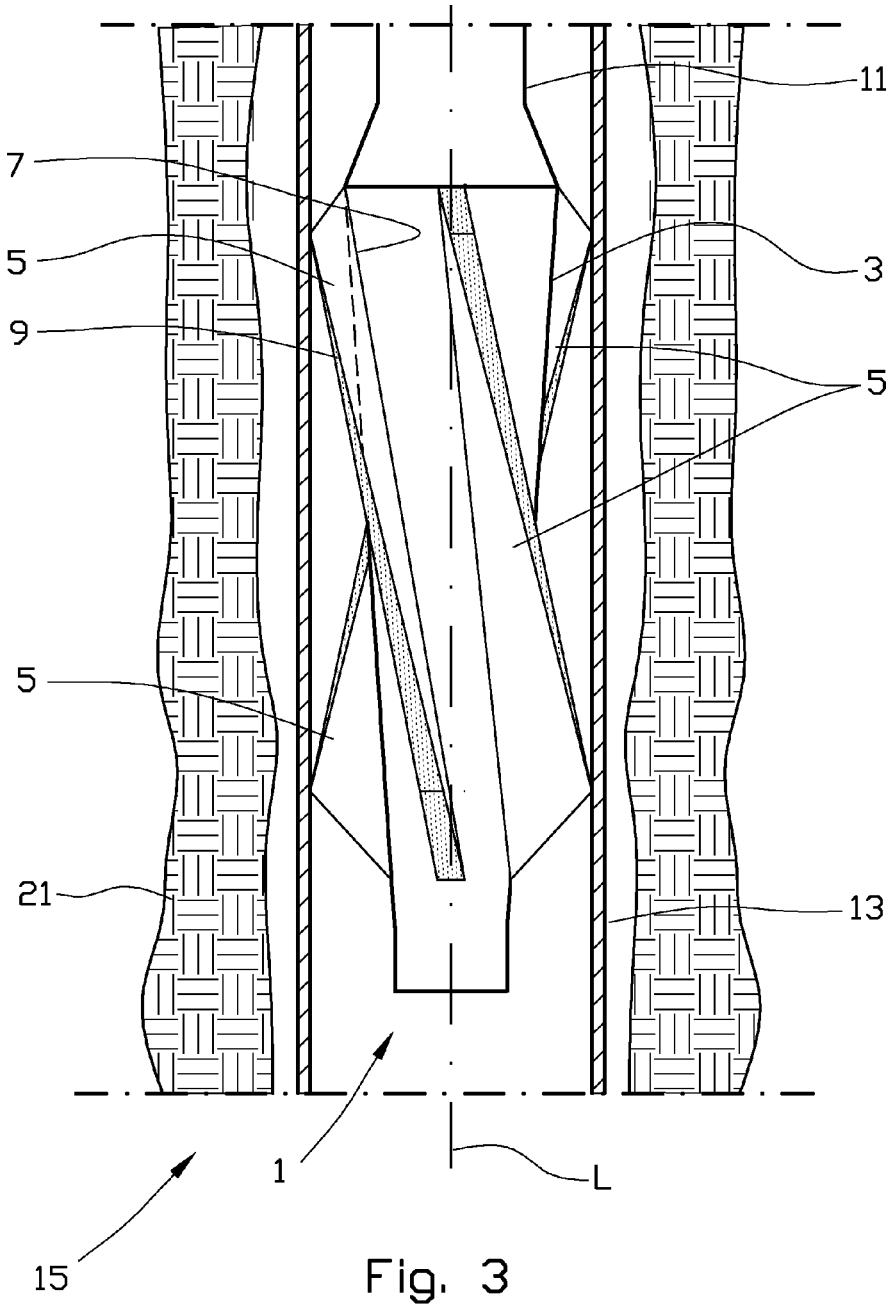
FIG. 3 shows the same as FIG. 2, but an upper portion of the carrier body having a larger external diameter than a lower portion.

FIG. 3 shows an apparatus 1 which resembles the apparatus 1 shown in FIG. 2, but in which the carrier body 3 is of a conical shape wherein an upper portion of the carrier body 3 has a larger external diameter than a lower portion of the carrier body 3. Because of the conical shape of the carrier body 3, the displacement members or blades 5 have a smaller radial extent in the upper portion of the apparatus 1 than the radial extent in the lower portion of the apparatus 1.

The purpose of the design that is shown in FIG. 3 is to provide a variable annulus between the carrier body 3 and the casing 13, so that the fluidized plugging material will be displaced at different rates along the longitudinal axis of the apparatus 1. This has the effect of different pressure regimes arising, among other things.

Figure 4:
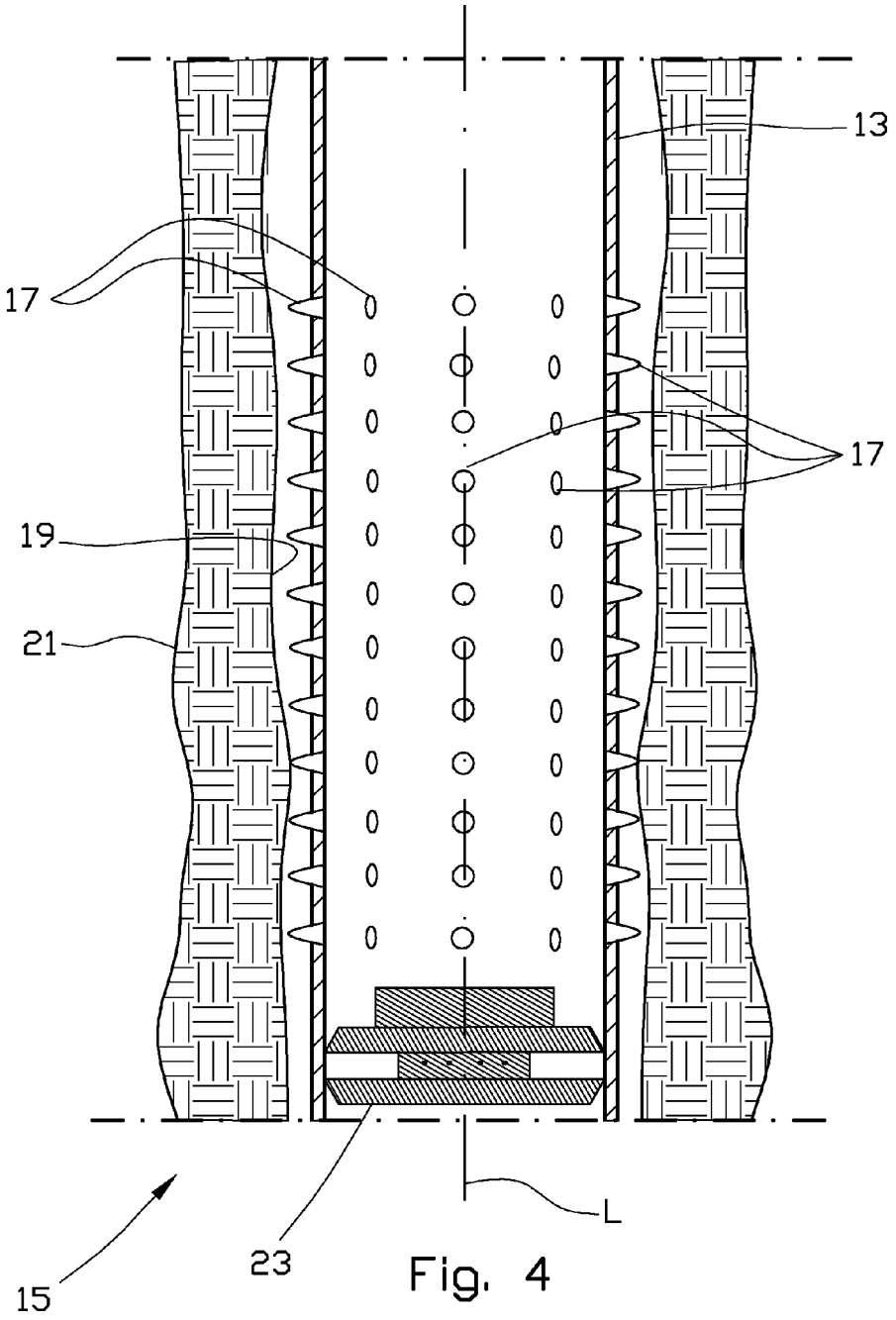
FIG. 4 shows a casing in a well, in which a portion of the casing is provided with perforations and in which a plug has been set in a portion of the casing located below the perforated portion.

FIG. 4 shows a portion of a well 15 which is provided with a casing 13. The casing 13 is provided with perforations 17 which have been provided, in the embodiment shown, by means of blasting charges. An annulus 19 is defined between a portion of the casing 13 and a formation 21.

A plug 23 of a kind known per se is placed in a portion of the well 15 located lower in the well than the perforated portion of the casing 17. The purpose of the plug 23 is to provide a base or a support for a fluidized plugging material (not shown in FIG. 4) which is to be carried into the well 15.

Figure 5A:
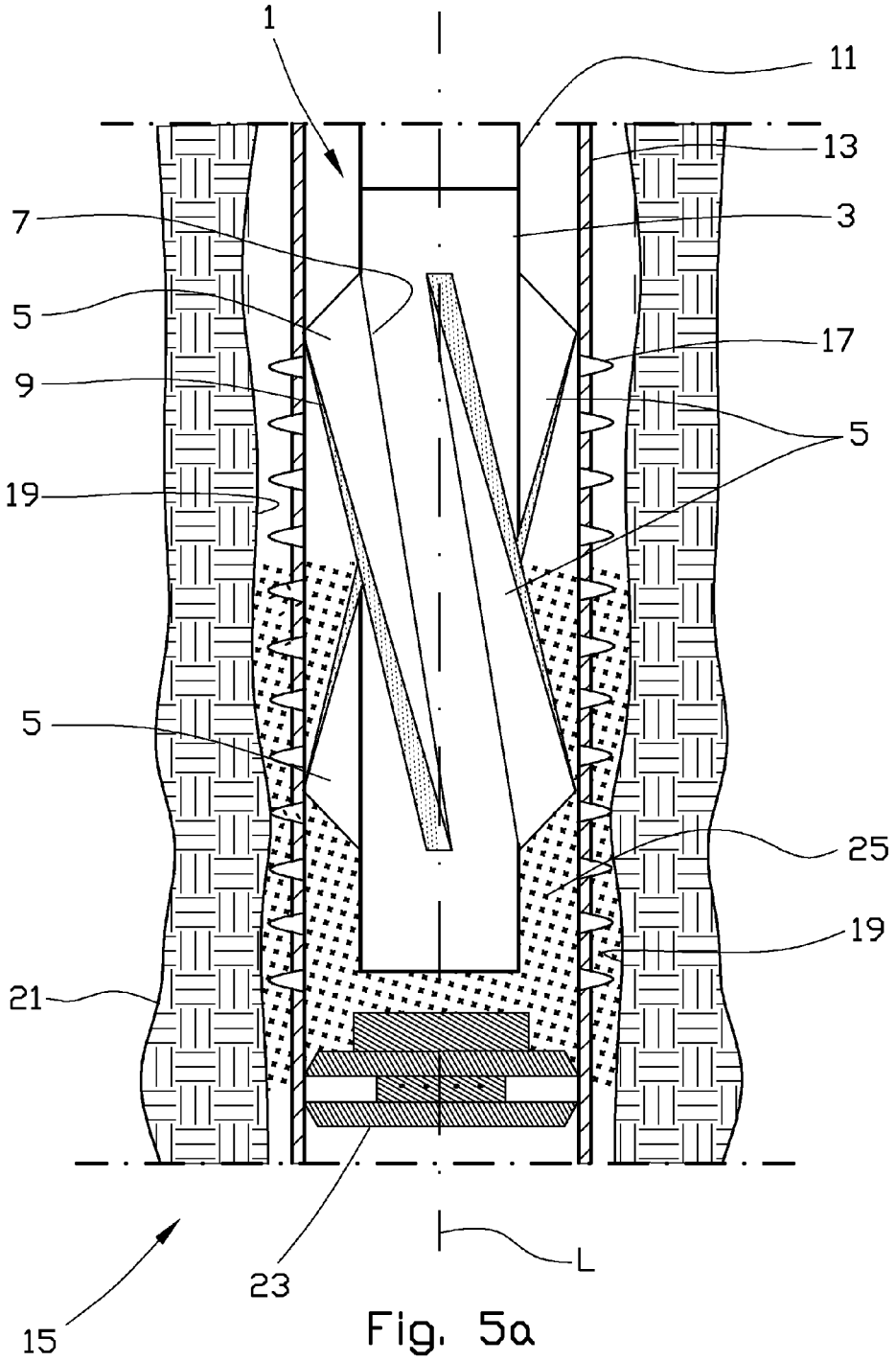
FIG. 5*a* shows the casing of FIG. 4, but with an apparatus of the kind shown in FIG. 2 being in a lower portion of the well portion to be plugged, and the apparatus driving fluidized plugging material out through the perforations and into an annulus defined by the casing and a formation.

FIG. 5*a* shows the well 15 of FIG. 4, but the apparatus 1 shown in FIG. 2 having been moved to a lower portion of the section of the well 15 which is to be plugged by means of a fluidized plugging material 25. In the embodiment shown, the fluidized plugging material is supplied through a bore extending through the driving device 11 and the carrier body 3 while, at the same time, the apparatus 1 is being rotated around the longitudinal axis L.

Figure 5B:
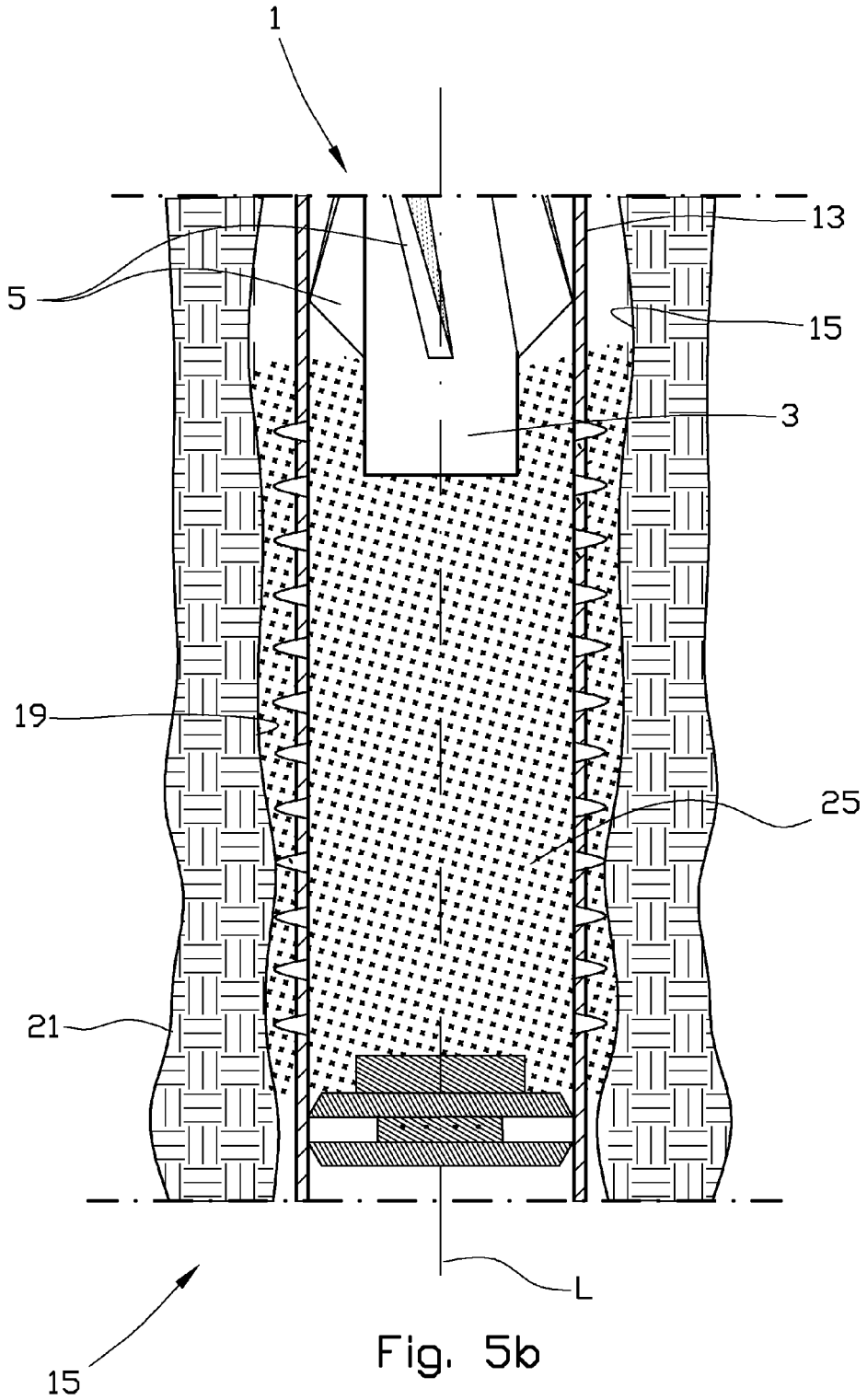
FIG. 5*b* shows the same as FIG. 5*b*, but where fluidized plugging material has been driven out through the entire perforated portion of the casing, and where the apparatus is in the process of being pulled cut of the well.

Because of the above-mentioned spreading or spatula effect, the blades 5 press or squeeze the plugging material 25 against the inside of the casing 13 and out through the perforations 17 and further into the annulus 19, FIG. 5*b* shows the apparatus 1 of FIG. 5*a* as the apparatus 1 is in the process of being pulled out of the well 15 after a desired portion of the well has been plugged. The apparatus 1 is thus reusable.

Figure 6A:
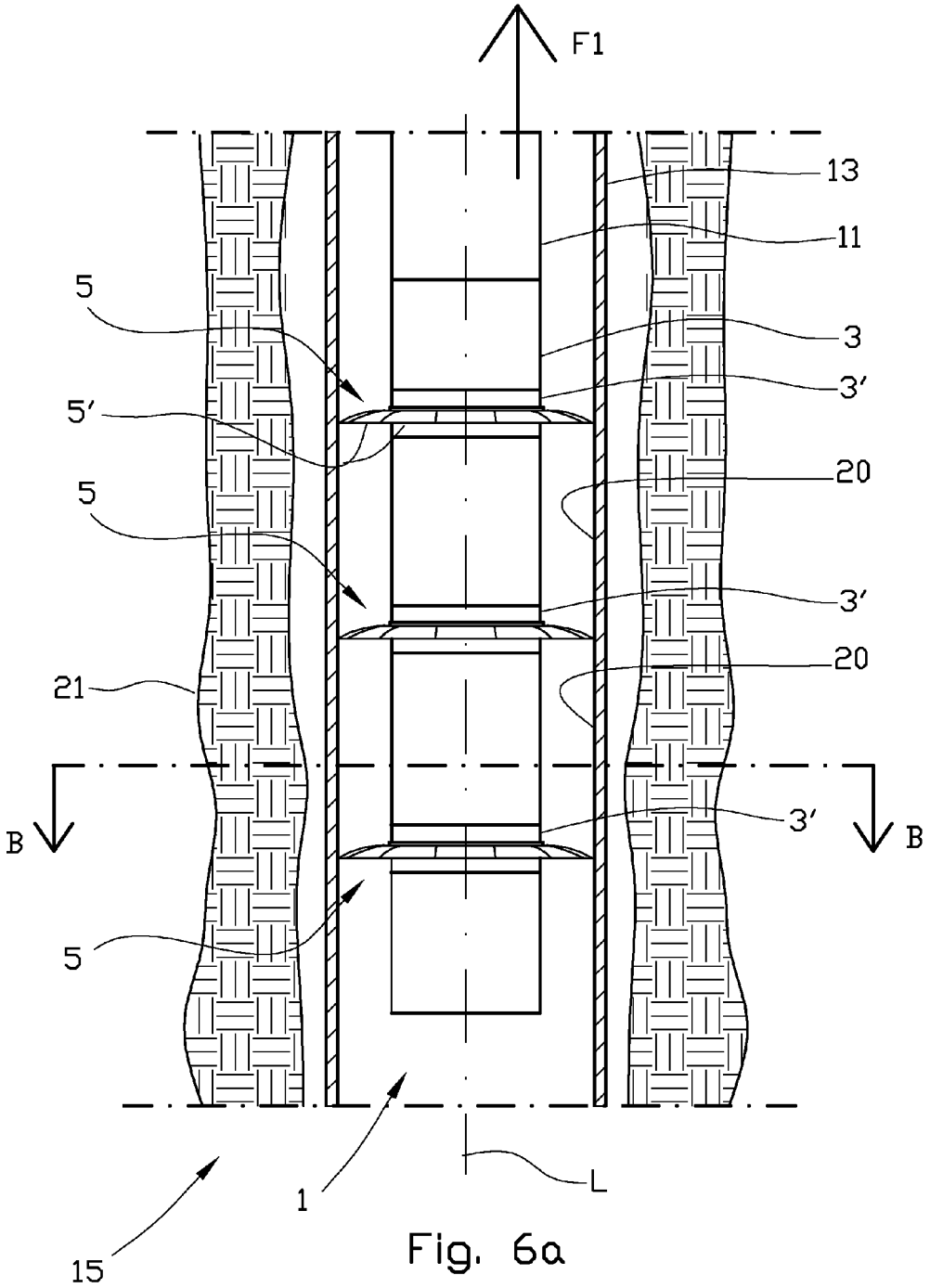
FIG. 6*a* shows the apparatus according to the present invention in an embodiment in which the displacement member is constituted by collar-shaped bodies hingedly connected to the carrier body, and in which the apparatus is in a movement in a first direction.
Figure 6B:
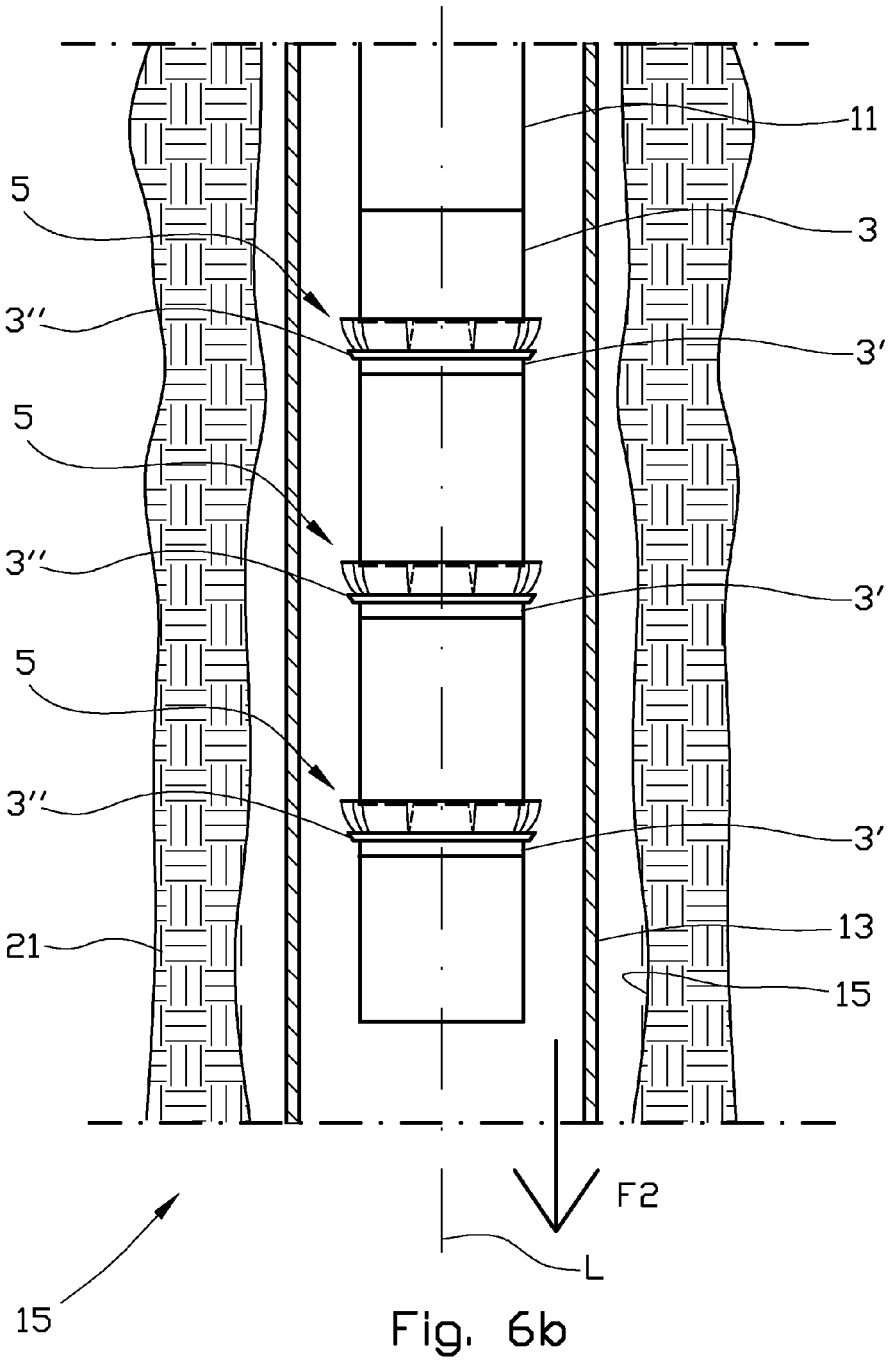
FIG. 6*b* shows the apparatus of FIG. 6*a*, but the apparatus being in a movement in a second direction which is the opposite of the first direction.

FIGS. 6*a* and 6*b* show the apparatus 1 according to the present invention in an embodiment in which the displacement member 5 is formed by three sets of collar-shaped bodies 5, the sets being spaced apart. The collar-shaped bodies 5 are attached to the carrier body 3 by means of a hinging device (not specifically shown). The hinging device is of a kind known per se that is arranged to hold the collar-shaped bodies 5 in an unfolded position when the apparatus 1 is being moved in a first direction as shown by means of the arrow F1 in FIG. 6*a*, but the collar-shaped bodies 5 collapsing and being moved in towards the carrier body 3 as the apparatus 1 is being moved in a second direction as shown by means of the arrow F2 in FIG. 6*b*. Alternatively, the arrows in FIGS. 6*a* and 6*b* may be placed the other way round, but then the shoulder element 3" shown in FIG. 6*b* will have to be placed on an upper side of the attachment portion of the collar-shaped bodies 5, and not the lower side as shown in FIG. 6*b*.

In the embodiment shown, the hinging devices are attached to pipe pieces 3' screwed together between sections of carrier bodies 3.

The purpose of the "jellyfish motion", which is provided by means of the hinged attachment of the collar-shaped bodies 5, is first and foremost to bring fluidized plugging material, which is carried in from a lower, or possibly an upper, portion of the apparatus 1, to enter a space 20 defined between two sets of collar-shaped bodies 5, the carrier body 3 and the casing 13.

The displacement members 5 that are shown in FIGS. 6*a* and 6*b* require a driving device 11 that provides a reciprocating motion along the longitudinal axis L of the casing 13. Such a reciprocating driving device may be of a kind known per se and will therefore not be mentioned in any greater detail in this document.

In an alternative embodiment, the apparatus 1 shown in FIG. 6*a* may be provided with an attachment portion 7 which is fixed such as for the blades 5 shown in FIGS. 1*a* and 1*b*, for example. The collar-shaped bodies 5 will then project towards the casing 13 independently of whether the apparatus 1 is moving in the direction F1 or F2. To make it easier for fluidized plugging material carried in from a lower, possibly an upper, portion of the apparatus 1 to enter the annuli defined between two sets of collar-shaped bodies 5, the carrier body 3 and the casing 13, it is an advantage if the radial extent of the collar-shaped elements 5 is smaller than the internal diameter of the casing 13.

To achieve a desired spreading or spatula effect corresponding to that described for the apparatuses shown in FIGS. 1-3, the collar-shaped bodies 5 may be, with respect to materials and flexibility, of the kind that is described for the blades 5 shown in said figures.

Figure 7:
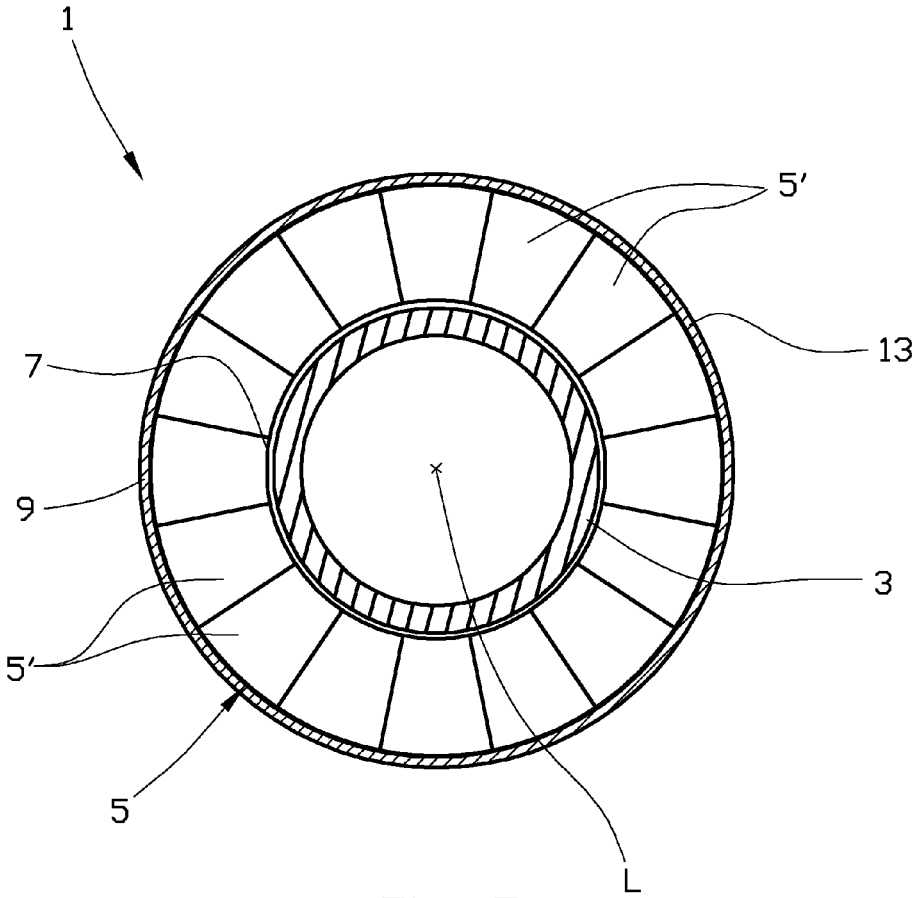
FIG. 7 shows, on a larger scale, a section through the line A-A shown in FIG. 6*a*, but only the apparatus and the casing being shown.

FIG. 7 shows, on a larger scale, a section through the line B-B shown in FIG. 6*a*. In FIG. 7 only the apparatus 1 and the casing 13 are shown. In the embodiment shown, the collar-shaped body 5 is composed of a plurality of collar sector elements 5' (sixteen shown). Even though FIG. 7 sows said section B-B, FIG. 7 might equally well have been a section seen from an upper side of a collar-shaped body extending in a helix around the carrier element 3 shown in FIG. 6*a*, for example.

Figure 8:
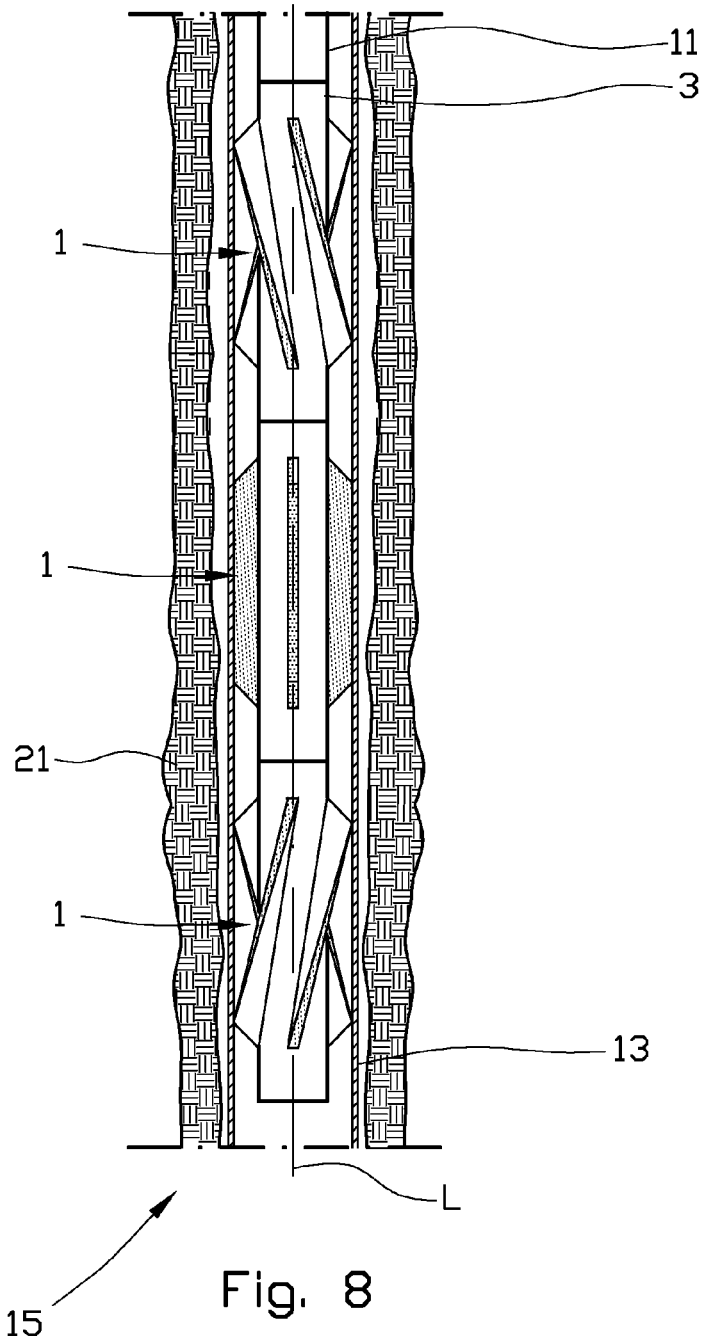
FIG. 8 shows an apparatus according to the invention, the apparatus being composed of several apparatuses with displacement members of different nature.

FIG. 8 shows, on a smaller scale, an apparatus 1 according to the invention, the apparatus being assembled into a stack of several apparatuses 1 with displacement members 5 of different nature.

Figure 9:
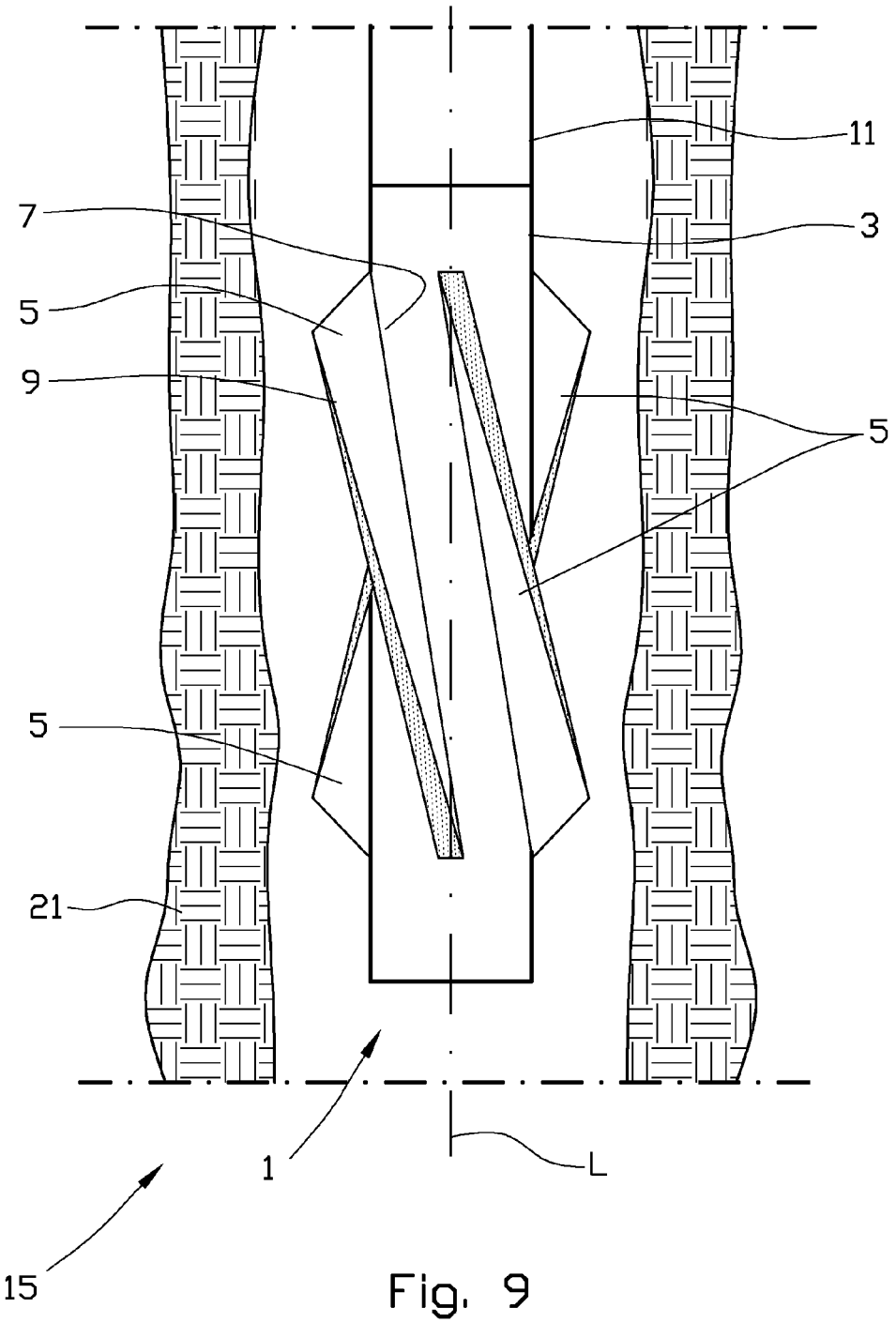
FIG. 9 shows the apparatus of FIG. 2 shown in an application for positioning a fluidized plugging material in an open-hole section.

FIG. 9 shows the apparatus of FIG. 2 shown in an application for positioning a fluidized plugging material in an open-hole section without casing. The fluidized plugging material is not shown in FIG. 9.

The invention claimed is:

1. A method of providing a permanent or temporary plug in a casing in a well, wherein the plug is provided by means of a fluidized plugging material which is carried into the well from a surface of the well, wherein the method comprises:

using an apparatus for positioning the fluidized plugging material in the well, the apparatus comprising:

a carrier body defined by an endless side portion extending between a first end portion and a second end portion;

at least one displacement member arranged on the carrier body, wherein the displacement member is defined by a surface of the carrier body and a free end portion facing outwards from the carrier body, whereby the free end portion will face an inside of the casing when placed therein; and a driving device connected to the carrier body for allowing the carrier body and the at least one displacement member to be set in motion in the casing;

moving the apparatus into the casing in the well;

activating the driving device and thus setting the apparatus in motion in the casing and supplying the fluidized plugging material from the surface of the well, thereby setting the fluidized plugging material in motion in the casing;

continuing moving the apparatus for a predetermined time after having supplied all of the plugging material; and pulling the apparatus out of the well, whereby the apparatus is retrievable from the well.

2. The method according to claim 1, wherein the well is an oil well or a gas well.

3. The method according to claim 1, wherein the casing is a non-perforated casing.

4. The method according to claim 1, wherein the casing is a perforated casing having perforations for providing fluid-communication channels between an internal bore of the casing and an outside of the casing.

5. The method according to claim 1, wherein the driving device is a pipe string which is arranged to be set in rotation around a longitudinal axis of the casing, so that the movement of the apparatus is a rotational movement around the longitudinal axis of the casing.

6. The method according to claim 1, wherein the displacement member is a blade.

7. The method according to claim 6, wherein the free end portion of the blade is arranged to exhibit, at least upon rotation of the carrier body, a deflection relative to a central contact portion between the blade and the carrier body.

8. The method according to claim 6, wherein the carrier body and the at least one blade, upon rotation before the apparatus has been moved into the casing, circumscribe a circle having a diameter which is larger than an internal diameter of the casing, whereby the at least one blade assumes a curvature when placed in the casing.

9. The method according to claim 6, wherein the carrier body and the at least one blade, upon rotation thereof, circumscribe a circle having a diameter which is equal to or smaller than an internal diameter of the casing.

10. The method according to claim 6, wherein a longitudinal axis of the at least one blade extends parallel to a longitudinal axis of the carrier body.

11. The method according to claim 6, wherein a longitudinal axis of the at least one blade extends at an angle relative to a longitudinal axis of the carrier body.

12. The method according to claim 1, wherein the driving device is a reciprocating driving means which is arranged to provide forward and backward movements of the at least one displacement member along a longitudinal axis of the casing.

13. The method according to claim 12, wherein the displacement member is a collar-shaped body.

14. The method according to claim 13, wherein the free end portion of the collar-shaped body is arranged to exhibit, at least upon movement, a deflection relative to a central contact portion between the collar-shaped body and the carrier body.

15. The method according to claim 13, wherein the collar-shaped body extends in a helix around the carrier body.

16. The method according to claim 13, wherein the collar-shaped body extends at least 360° around the carrier body.

17. The method according to claim 13, wherein the collar-shaped body includes at least two collar sector elements.

18. The method according to claim 17, wherein at least one of the collar sector elements is provided with a hinged attachment portion, so that the free end portion is allowed to be moved inward towards the carrier body during one of the forward and backward movements of the apparatus in the casing.

19. The method according to claim 1, wherein the plugging material is a hardenable material.

20. The method according to claim 19, wherein the hardenable material is a cement-based plugging material.

21. The method according to claim 19, wherein the load capacity of the at least one displacement member is higher than the loads affecting the displacement member upon movement of the apparatus in non-hardened plugging material, but lower than the loads affecting the displacement member upon movement of the apparatus in hardened plugging material, so that at least a portion of the displacement member will break if a hardening process exceeds a predetermined level.

22. The method according to claim 1, wherein one portion of the carrier body has a larger external diameter than another portion of the carrier body.

23. The method according to claim 1, wherein the at least one displacement member includes two or more spaced-apart displacement members.

24. The method according to claim 1, wherein the carrier body is provided with a bore arranged to carry the plugging material, which is received from the surface of the well, out through a lower end portion of the apparatus.

25. The method according to claim 1, wherein at least a portion of the carrier body is made of the same material as the at least one displacement member.

* * * * *